US009452876B2

(12) United States Patent
Anelevitz et al.

(10) Patent No.: US 9,452,876 B2
(45) Date of Patent: Sep. 27, 2016

(54) THERMAL CONTAINER

(71) Applicant: 2115730 Ontario Inc., Toronto (CA)

(72) Inventors: Nolan Anelevitz, Toronto (CA); Spyros Theoharis, Mississauga (CA)

(73) Assignee: THERMOTWIST INC., Toronto, Ontario (CA)

( * ) Notice: Subject to any disclaimer, the term of this patent is extended or adjusted under 35 U.S.C. 154(b) by 201 days.

(21) Appl. No.: 14/102,085

(22) Filed: Dec. 10, 2013

(65) Prior Publication Data

US 2015/0158658 A1 Jun. 11, 2015

(51) Int. Cl.
*F21V 33/00* (2006.01)
*B65D 81/38* (2006.01)
*A47G 19/22* (2006.01)

(52) U.S. Cl.
CPC ..... *B65D 81/383* (2013.01); *A47G 19/2227* (2013.01); *A47G 2019/2238* (2013.01); *B65D 2203/12* (2013.01)

(58) Field of Classification Search
CPC ..... B65D 81/383; B65D 81/3846; B65D 81/3837; B65D 2203/12
USPC ..... 220/592.16, 592.17, 592.2, 592.23; 362/101, 154; 215/12.1, 13.1
See application file for complete search history.

(56) References Cited

U.S. PATENT DOCUMENTS

| | | | | |
|---|---|---|---|---|
| 3,308,290 | A | 3/1967 | Brown | |
| 5,301,982 | A | 4/1994 | Brotz | |
| 5,567,040 | A | 10/1996 | Tabanera | |
| 5,597,183 | A | 1/1997 | Johnson | |
| 6,034,481 | A | 3/2000 | Haynes | |
| 6,213,616 | B1 * | 4/2001 | Chien | A47G 19/2227 362/101 |
| 6,280,053 | B1 | 8/2001 | Chien | |
| 6,367,652 | B1 * | 4/2002 | Toida | B65D 25/2811 220/592.16 |
| 6,511,196 | B1 * | 1/2003 | Hoy | A47G 19/2227 362/101 |
| 6,558,015 | B1 | 5/2003 | Marmaropoulos et al. | |
| 6,619,811 | B2 * | 9/2003 | Wang | A47G 19/2227 362/101 |
| 6,886,864 | B2 | 5/2005 | Nelson et al. | |
| 7,083,295 | B1 | 8/2006 | Hanna | |
| 7,878,365 | B1 * | 2/2011 | Meehan | A47G 19/2227 215/10 |
| 2005/0091890 | A1 | 5/2005 | Snyder | |
| 2007/0029939 | A1 | 2/2007 | Burkum et al. | |
| 2007/0082123 | A1 | 4/2007 | Aldarondo et al. | |
| 2007/0171154 | A1 | 7/2007 | Collins et al. | |

FOREIGN PATENT DOCUMENTS

| | | | |
|---|---|---|---|
| WO | 2007/018996 | A1 | 2/2007 |
| WO | 2007/021362 | A2 | 2/2007 |
| WO | 2008/070098 | A2 | 6/2008 |

* cited by examiner

*Primary Examiner* — Laura Tso
*Assistant Examiner* — Naomi M Wolford
(74) *Attorney, Agent, or Firm* — Philip C. Mendes da Costa; Bereskin & Parr LLP/S.E.N.C.R.L., s.r.l.

(57) ABSTRACT

A thermal container comprises an outer container assembly, an inner container and a lid. The outer container assembly has an outer sleeve and an inner sleeve. The lid has engagement members that releasably engage the engagement members on the outer surface of the top end of the outer sleeve. The inner container is rotatably securable to an inner surface of the longitudinally extending wall of the inner sleeve.

14 Claims, 8 Drawing Sheets

THERMAL CONTAINER

FIELD

The present application relates to the field of thermal containers, such as thermal containers for beverages or food items.

INTRODUCTION

Various types of thermal containers are known. Thermal containers, such as thermal coffee mugs, are insulated so that a beverage or food item that is at a temperature either warmer or cooler than the ambient temperature may be transported and consumed during transport or later. Typically, thermal containers utilize a double walled construction and a removable lid. A sealed air gap is provided between the inner and outer walls of the double walled construction. After the thermal container has been used, the removable lid may be removed and the lid and the thermal container may be washed so that the thermal container is cleaned before being reused.

SUMMARY

In a first aspect, a triple walled thermal container is provided. Accordingly, the thermal container comprises an outer wall, and first inner wall positioned inwardly of the outer wall, and a second inner wall positioned inwardly of the first inner wall. The outer wall and the first inner wall be a unitary assembly and may be of any construction utilized for double walled thermal containers. A liquid impermeable container, which comprises the second inner wall, is removably receivable in the first inner wall, e.g., it may be removably receivable in a unitary assembly comprising the outer wall and the first inner wall.

An advantage of this design is that, after the thermal container has been used, the liquid impermeable container may be removed for cleaning. Accordingly, the unitary assembly need not be cleaned. Instead, just the liquid impermeable container and the lid may be immersed in water (e.g., washed in a sink or placed in a dishwasher). Accordingly, the unitary body need not be subjected to the stresses of being cleaned.

A further advantage of this design is that an illuminable graphic panel may be provided between the outer wall and the first inner wall (e.g., in an air gap of the unitary assembly) and an electronics unit may also be provided in the unitary assembly (e.g., below a bottom wall of the first inner wall and above a bottom closure panel of the outer wall). Due to the provision of the removable liquid impermeable container, the unitary assembly does not function as a drinking container and therefore the unitary assembly need not be cleaned. Therefore, the electronics unit and the illuminable graphic panel need not be provided in a water tight compartment. Further, even if water tight seals are used to enclose the electronics unit and the illuminable graphic panel, the unitary assembly may be handled without concern that the seals may leak during cleaning.

In accordance with this aspect, there is provided a thermal container comprising an outer container assembly, which may be a unitary assembly, comprising a longitudinally extending outer sleeve having a top end and a bottom end and a longitudinally extending inner sleeve having a top end and a bottom end. The inner sleeve may be spaced from and face the outer sleeve to define a volume between the inner and outer sleeves. A bottom panel may close the bottom end of the outer sleeve and an electronics unit may be provided adjacent the bottom panel. A longitudinally extending illuminable graphic panel may be positioned in the volume and electrically connected to the electronics unit. A first inner container, a liquid impermeable container, may be removably receivable in the inner sleeve and may have a closed bottom positioned above the electronics unit when the inner container is positioned in the outer container assembly.

In some embodiments, the first inner container may be releasably lockably securable to the outer container assembly.

In some embodiments, the first inner container may have an outer longitudinally extending wall, the inner sleeve may have an inner longitudinally extending wall, and the inner container may be rotatably securable to the inner sleeve.

In some embodiments, the inner sleeve may be slidably receivable in the top end of the outer sleeve. The inner sleeve may have an abutment member limiting the extent of insertion of the inner sleeve into the outer sleeve, and the bottom panel may be secured to the inner sleeve.

In some embodiments, the abutment member may comprise a flange at the top end of the inner sleeve.

In some embodiments, the inner sleeve may comprise a sidewall and a plurality of legs, the sidewall having a lower end spaced from the bottom end of the outer sleeve. The plurality of legs may extend downwardly from the sidewall.

In some embodiments, the bottom panel may be securable to the plurality of legs.

In some embodiments, the inner sleeve may comprise a sidewall and a plurality of legs, the sidewall having a lower end spaced from the bottom end of the outer sleeve and the plurality of legs may extend downwardly from the sidewall. A lower panel may close the lower end of the sidewall.

In some embodiments, the electronics unit may comprise a battery compartment provided on the bottom panel, an on/off switch and a controller.

In some embodiments, the controller may be mounted to the inner sleeve.

In some embodiments, the inner sleeve may comprise a sidewall and a plurality of legs, the sidewall having a lower end spaced from the bottom end of the outer sleeve and the plurality of legs may extend downwardly from the sidewall. A lower panel may close the lower end of the sidewall, and a controller mount may be provided on the lower panel on the inner sleeve.

In some embodiments, the thermal container may further comprise a lid removably securable to the top end of the outer sleeve.

In some embodiments, the lid may have a drinking opening and a flap moveable between a closed position in which the drinking opening is closed and an open position.

In some embodiments, the thermal container may further comprise a second inner container. The second inner container may have a longitudinally extending sidewall that has a top end is positioned above the top end of the outer sleeve when the inner container is positioned in the outer container assembly.

In some embodiments, the illuminable graphic panel may comprise an electroluminescent panel.

In accordance with a second aspect, a triple walled thermal container is provided wherein a liquid impermeable container defines the innermost wall of the triple walled construction. In accordance with this aspect, the liquid impermeable container is releasably lockably securable in the thermal container. Accordingly, the thermal container may comprise a unitary assembly defining an outer container assembly with an inner container removably receivable therein. The inner container may be unlocked so that it may be removed for cleaning. Once cleaned, the inner container may be inserted into the outer container assembly and locked in position. An advantage of this design is that the inner container will remain in position in the thermal container during use. When locked into position, the inner container will not slip when a person is drinking and thereby spill hot liquid over the user.

In accordance with this aspect, there is provided a thermal container comprising an outer container assembly comprising a longitudinally extending outer sleeve having a top end and a bottom end, and a longitudinally extending inner sleeve having a top end and a bottom end. The inner sleeve may be spaced from and face the outer sleeve to define a volume between the inner and outer sleeves. A bottom panel may close the bottom end of the outer sleeve. The thermal container may further include an inner container having a closed bottom. The inner container may be removably receivable in the inner sleeve and releasably lockably securable to the outer container assembly.

In some embodiments, the inner sleeve may be slidably receivable in the top end of the outer sleeve. The inner sleeve may have an abutment member limiting the extent of insertion of the inner sleeve into the outer sleeve, and the bottom panel may be secured to the inner sleeve.

It will be appreciated that this aspect may use any of the optional embodiments of the first aspect.

In accordance with a third aspect, a thermal container kit is provided. The kit comprises an outer container assembly, which is of a double walled construction with alternate inner containers that are removably receivable in the outer container assembly. In accordance with this aspect one of the inner containers may have a height such that the top of the removable inner container may be positioned above the top of the outer container assembly. An advantage of this design is that one removable inner container may be a drinking container which may be closed with a lid, thereby creating, e.g., a coffee mug, and a second removable container which is taller may be inserted into the outer container assembly to create a vase.

In accordance with this thirds aspect, there is provided a thermal container kit comprising an outer container assembly comprising a longitudinally extending outer sleeve having a top end and a bottom end, and a longitudinally extending inner sleeve having a top end and a bottom end. The inner sleeve may be spaced from and face the outer sleeve to define a volume between the inner and outer sleeves. A bottom panel may close the bottom end of the outer sleeve. The thermal container kit may further include a first inner container having a closed bottom, and removably receivable in the inner sleeve. The thermal container kit may further include a second inner container that may be alternately removably receivable in the inner sleeve. The second inner container may have a longitudinally extending sidewall that has a top end positioned above the top end of the outer sleeve when the inner container is positioned in the outer container assembly.

In some embodiments, at least one of the first and second inner containers may be releasably lockably securable to the outer container assembly.

It will be appreciated that this aspect may use any of the optional embodiments of the first aspect.

DRAWINGS

The drawings included herewith are for illustrating various examples of articles, methods, and apparatuses of the teaching of the present specification and are not intended to limit the scope of what is taught in any way.

DESCRIPTION OF VARIOUS EMBODIMENTS

Figure 1:
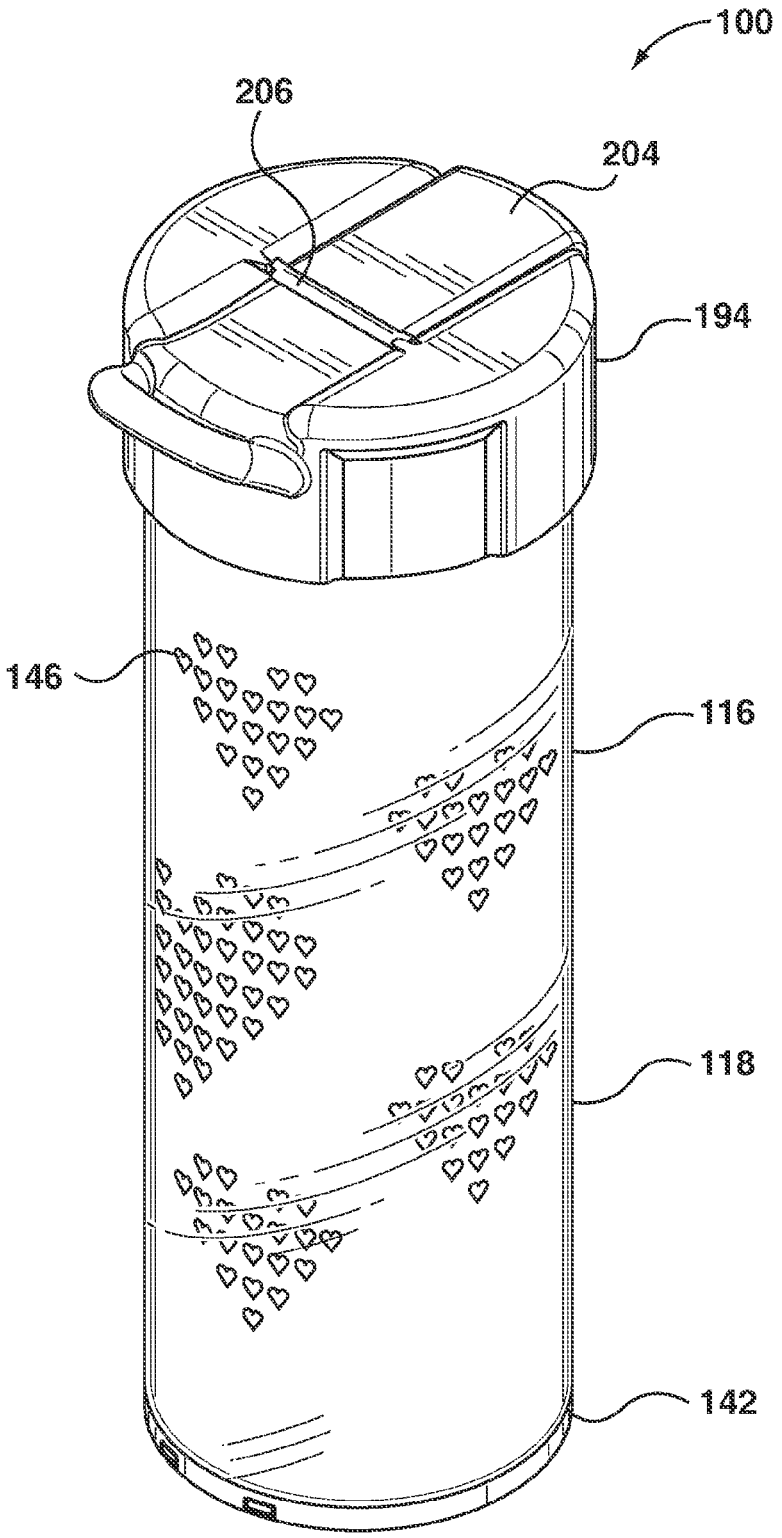
FIG. 1 shows a top perspective view of a thermal container, in accordance with at least one embodiment.
Figure 2:
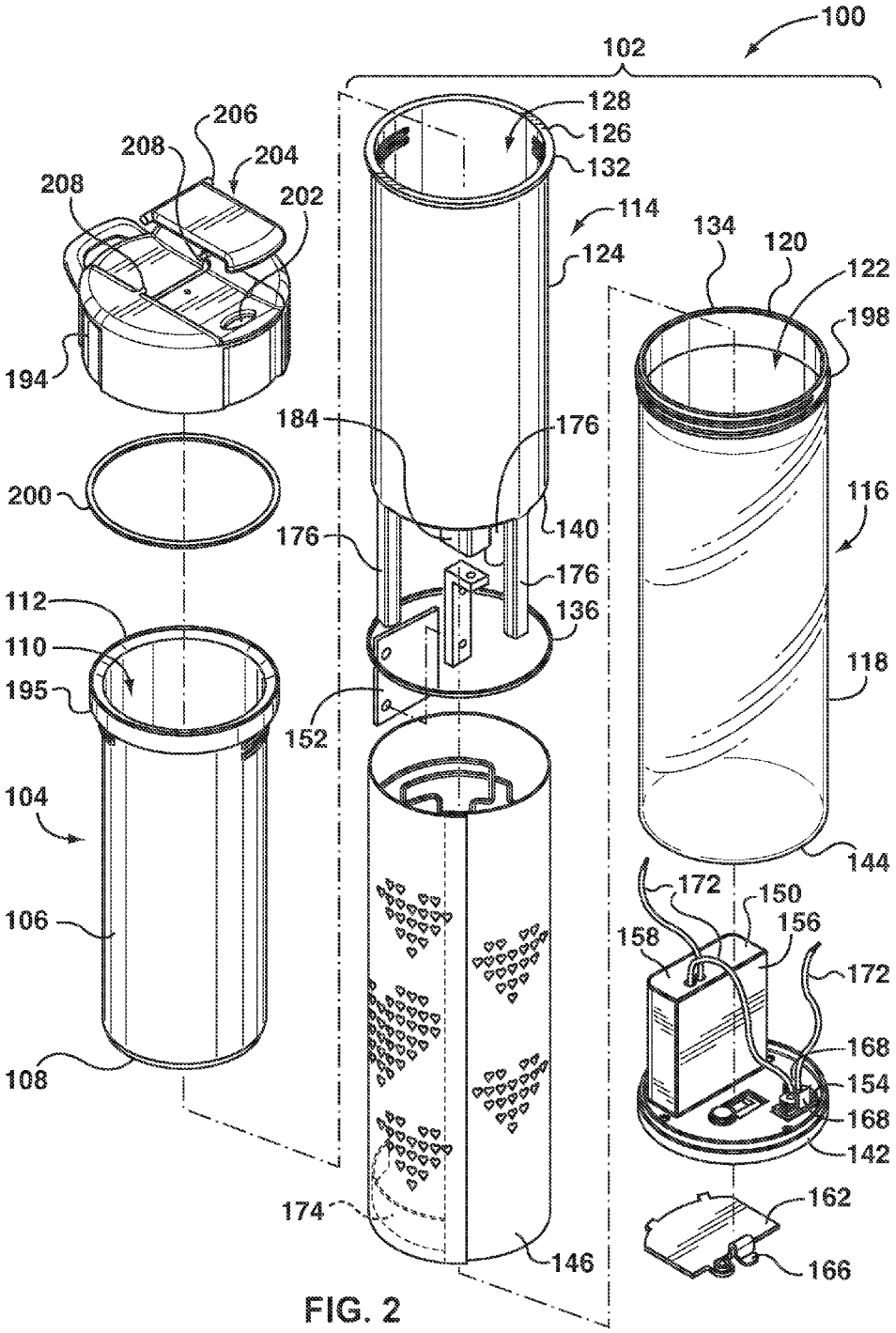
FIG. 2 shows an exploded top perspective view of the thermal container of FIG. 1, in accordance with at least one embodiment.
Figure 3:
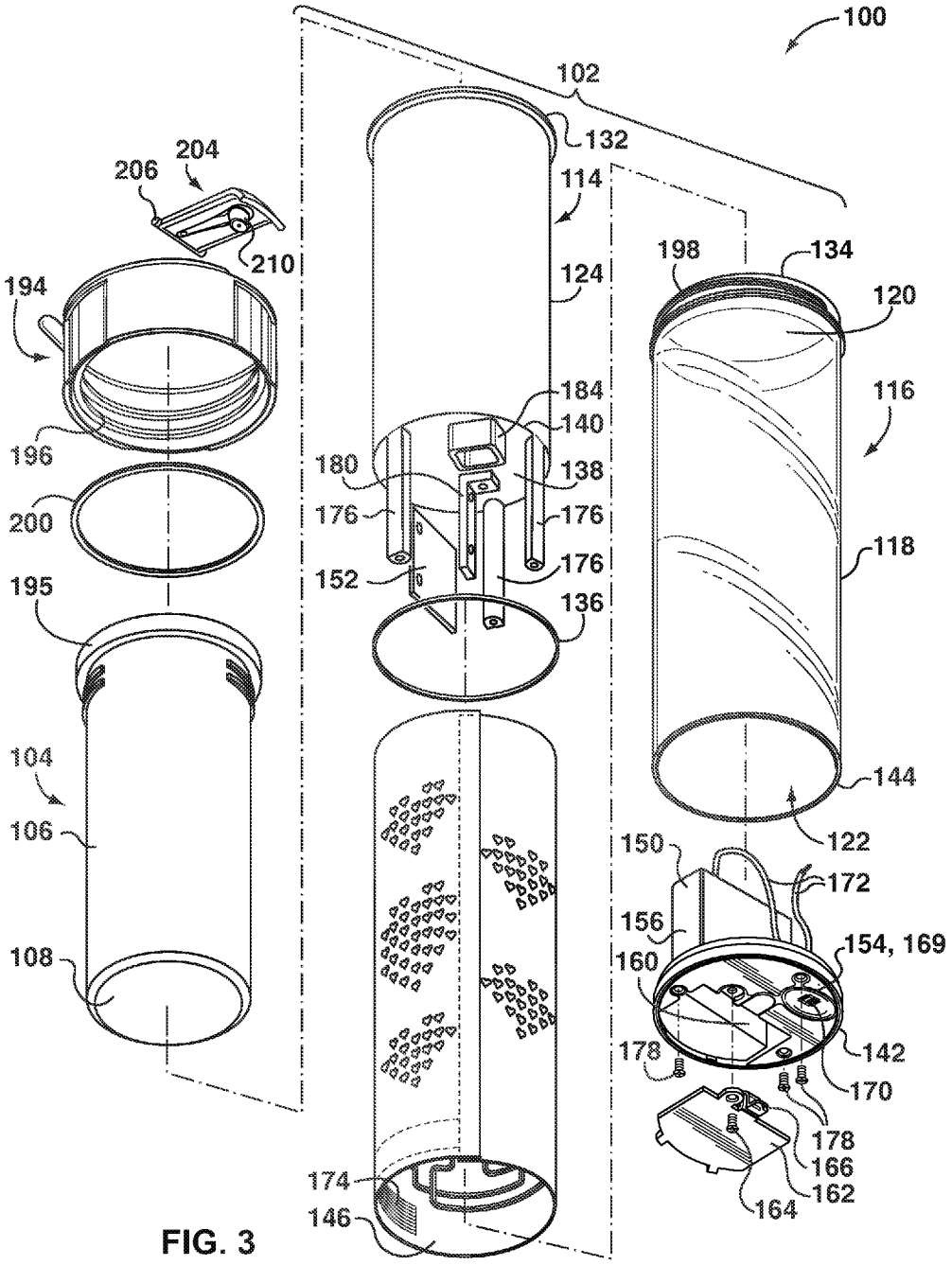
FIG. 3 shows an exploded bottom perspective view of the thermal container of FIG. 1, in accordance with at least one embodiment.

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As exemplified in FIGS. 1 to 3 and 9, thermal container 100 comprises an outer container assembly 102 and an inner container 104. Inner container comprises a container capable of holding a liquid. Inner container 104 may be of any design known in the thermal container arts. As exemplified, inner container 104 comprises an outer longitudinally extending wall 106 (which is exemplified as being substantially cylindrical) and a closed bottom 108 (which is shown as being substantially circular that together define an internal volume 110 for holding a substance (e.g. liquid and/or solid food or drink) and an opening 112 for receiving the substance. In alternative embodiments, inner container 104 may have any other suitable shape. For example, outer wall 106 may have a regular or irregular shape including two or more sides.

Inner container may be constructed from any liquid impermeable material such as plastic or metal.

Outer container 102 is of a double walled construction so as to provide thermal insulation to the contents of inner container 104. As exemplified in FIGS. 2 and 3, outer container assembly 102 comprises a longitudinally extending inner sleeve 114 and a longitudinally extending outer sleeve 116. Outer sleeve 116 is sized and shaped to receive inner sleeve 114 therein. As shown, inner sleeve 114 includes a longitudinally extending wall 124 that defines at least an upper opening 126 and an internal volume 128. Similarly, outer sleeve 116 is shown including a longitudinally extending wall 118 that defines at least an upper opening 120 and an internal volume 122. Inner sleeve 114 may be receivable in internal volume 122 of outer sleeve 116, such that longitudinally extending wall 124 of inner sleeve 114 faces longitudinally extending wall 118 of outer sleeve 116. Preferably, as explained subsequently, outer sleeve 116 and inner sleeve 114 are connected together such that outer container 102 is of a unitary construction, e.g., it may be handled as a single piece. It will be appreciated that outer container 102 may be disassembleable, e.g., outer sleeve 116 and inner sleeve 114 may be removably connected together, so as to enable parts to be repaired or replaced.

As outer container 102 is double walled, when inner container 104 is received in outer container assembly 102, outer container assembly 102 provides thermal insulation to help preserve the temperature of a contained substance. For example, such thermal insulation may permit a hot beverage to remain hot for an extended duration by reducing thermal conduction, convention, and radiation between the hot beverage and the environment outside of the outer container assembly 102. It will be appreciated that, if an air gap is provided between wall 106 of inner container 104 and inner sleeve 114 of outer container 102, then additional thermal insulation may be provided.

Inner container 104 may be removably receivable in outer container assembly 102. The removability of inner container 104 advantageously permits inner container 104 to be more easily cleaned and/or replaced. For example, inner container 104 may have a robust structure formed from dishwasher safe materials so that it may be washed in any manner. Outer container assembly 102 may have a more delicate structure due to seals, which are used to enclose electronics, wherein the seals may possibly fail in a dishwasher. In this example, inner container 104 may be removed from outer container assembly 102 and put in the dishwasher, while outer container assembly 102 may be gently cleaned by hand using a cloth if needed. Still, in alternative embodiments, inner container 104 is permanently received in outer container assembly 102 and thus not removable therefrom. As exemplified in FIG. 4, inner and outer sleeves 114 and 116 are preferably sized to define a volume 130 between the inner and outer sleeves 114 and 116 when inner sleeve 114 is received in outer sleeve 116. In the example shown, inner sleeve 114 is spaced from outer sleeve 116 and longitudinally extending walls 124 and 118 define an annular volume 130 therebetween. Volume 130 advantageously provides thermal insulation by reducing thermal conduction between inner and outer sleeves 114 and 116. Optionally, volume 130 is sealed, and more preferably vacuum sealed, which may advantageously reduce thermal convection between inner and outer sleeves 114 and 116.

Preferably inner sleeve 114 may form a seal with upper end 134 of outer sleeve 116 such that liquid will not enter volume 130 if a spill occurs while inner container 104 is being filled. Inner and outer sleeves 114, 116 may be sealed in any manner. For example, inner sleeve 114 may include an abutment member, such as flange 132 that interfaces with an upper end 134 of longitudinally extending wall 118 of outer sleeve 116. Optionally, a gasket, such as O-ring 136, may be interposed between flange 132 and upper end 134 to enhance the seal. Alternatively, or in addition, inner sleeve 114 may be permanently connected to outer sleeve 116, e.g. by adhesive, welds, screws, magnets, or by integrally forming inner sleeve 114 and outer sleeve 116.

Optionally, one or both of inner and outer sleeves 114 and 116 may have a closed bottom. Advantageously, a closed bottom on both of inner and outer sleeves 114 and 116 may cooperate to seal a lower end of volume 130. In the example shown, inner sleeve 114 includes a lower panel 138 that closes a lower end 140 of longitudinally extending wall 124 such that inner sleeve 114 and lower panel 138 define a liquid impermeable container. Preferably inner sleeve 114 and lower panel 138 are integrally formed (e.g., molded). Lower panel 138 cooperates with longitudinally extending wall 124 to define internal volume 128 of inner sleeve 114 into which inner container 104 is receivable. An advantage of this design is that if inner container 104 has a leak, or if liquid is accidentally received in volume 128, then electronics provided in the bottom of volume 130 will not be exposed to the liquid.

Outer container assembly 102 may further include a bottom panel 142 that connects to lower end 144 of outer sleeve 116 to close and preferably seal the lower end 144. Bottom panel 142 may connect to lower end 144 by any suitable means, including but not limited to adhesive, welds, screws, magnets, or by integrally forming bottom panel 142 and outer sleeve 116. Preferably bottom panel 142 is openable, or has an openable portion, to provide access to electronics in volume 130.

Advantageously, volume 130 between inner and outer sleeves 114 and 116 may also provide a space for an illuminable graphic panel 146. As shown, graphic panel 146 may be positioned between longitudinally extending walls 124 and 118 of inner and outer sleeves 114 and 116, respectively.

Figure 4:
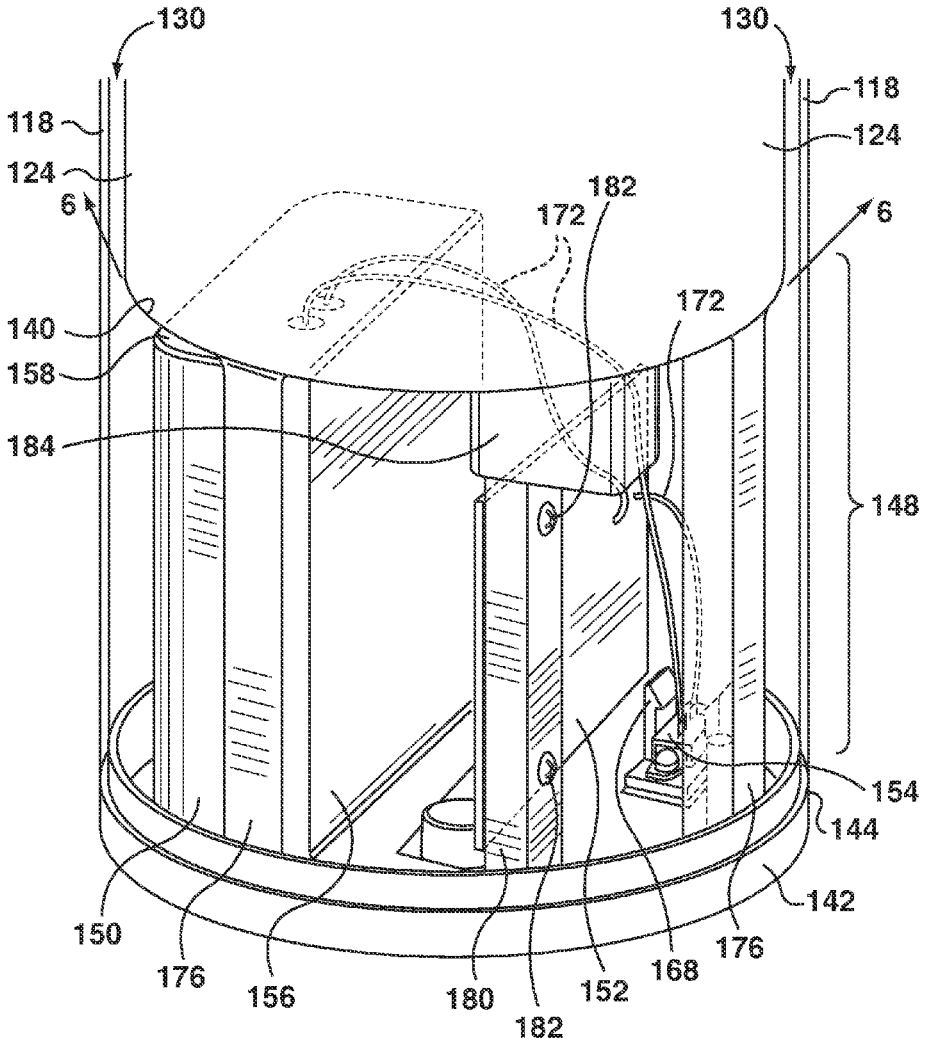
FIG. 4 shows a partial top perspective view of the lower end of the thermal container of FIG. 1, in accordance with at least one embodiment.

As shown most clearly in FIG. 4, outer container assembly 102 may optionally include an electronics unit 148. Electronics unit 148 may be electrically connected to illuminable graphic panel 146 to provide power and/or control signals to illuminate illuminable graphic panel 146. In the example shown, electronics unit 148 includes a battery compartment 150, a controller 152, and an ON/OFF switch 154. Alternative embodiments may include an electronics unit 148 containing different components, and optionally greater or fewer components. For example, electronics unit 148 may include a temperature sensor (e.g., to turn on when a hot liquid is placed in the internal container 104) and/or a motion sensor (e.g., to turn on when a person picks up the thermal container to drink) and/or a light sensor (e.g., to turn on when a room is dark) (not shown) that activates controller 152 instead of or in addition to ON/OFF switch 154.

Referring again to FIGS. 1-4, battery compartment 150 may be connected to bottom panel 142. For example, battery compartment 150 may be integrally formed with bottom panel 142 as shown, or alternatively fastened to bottom panel 142 by, e.g. adhesive, screws, or welds. As shown, battery compartment 150 includes side walls 156 and an upper wall 158 that define a battery cavity 160 for holding one or more batteries. Battery compartment 150 may further include a battery door 162 that is removably securable to battery compartment 150 and/or bottom panel 142 to provide selective access to battery cavity 160 for inserting or removing the batteries. Battery door 162 may be removably securable to battery compartment 150 by any suitable means. In the example shown, battery door 162 is securable to bottom panel 142 by a screw 164 and an integrally formed clip 166.

Figure 5:
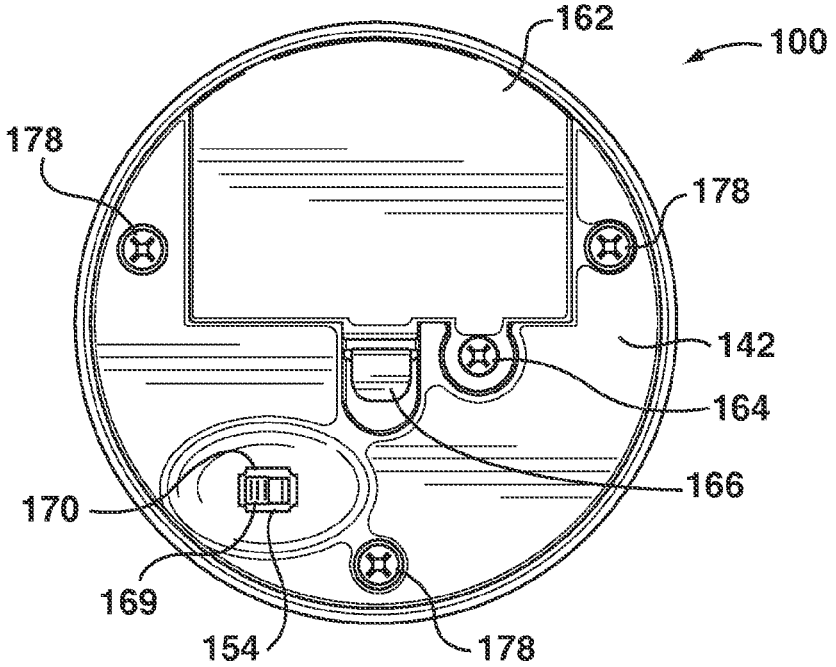
FIG. 5 shows a bottom plan view of the thermal container of FIG. 1, in accordance with at least one embodiment.
Figure 6:
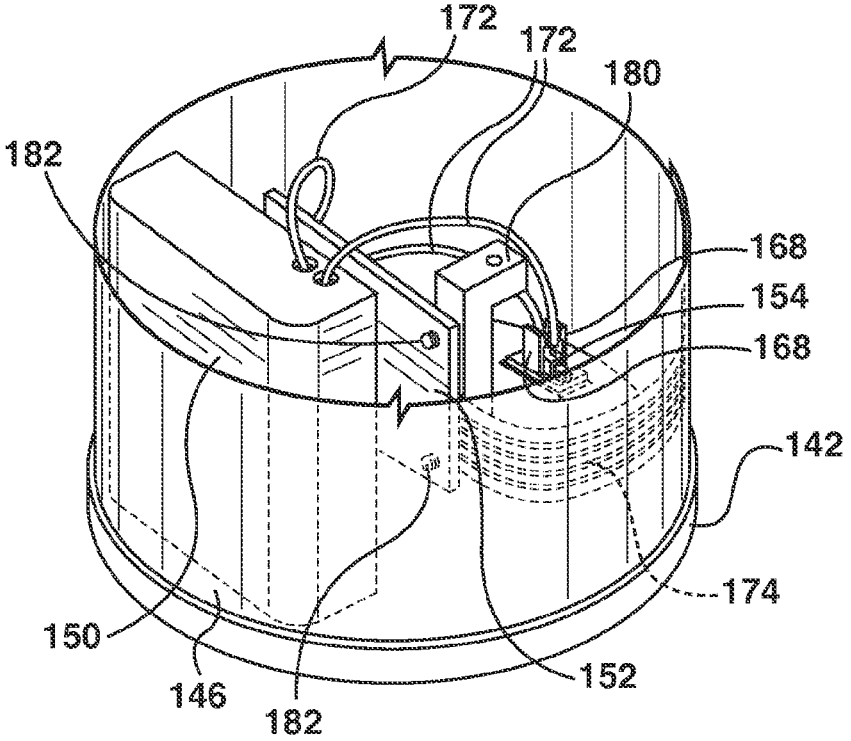
FIG. 6 shows a top perspective view of the lower end of the thermal container of FIG. 1 with the portion above line 6-6 in FIG. 4 removed, in accordance with at least one embodiment.

ON/OFF switch 154 may be connected to bottom panel 142. For example, ON/OFF switch 154 may be connected to bottom panel 142 by clips 168 as shown, and/or by adhesive, screws, or welds. Preferably, ON/OFF switch 154 is oriented so as to provide access to its articulating lever 169 when thermal container 100 is assembled. As exemplified in FIG. 5, bottom panel 142 may include a lever opening 170, and ON/OFF switch 154 may be positioned and oriented so that lever 169 protrudes through lever opening 170. This may provide a user with exterior access to toggle ON/OFF switch 154 using lever 169. ON/OFF switch 154 is preferably recessed below the lower surface of lower panel 142 so that thermal container may be stable when seated on a horizontal surface such as a table and/or standoff feet may be provided on lower panel 142.

In the example shown, controller 152 is positioned between ON/OFF switch 154 and battery compartment 150, and oriented vertically. Wires 172 electrically connect battery compartment 150 to controller 152 and ON/OFF switch 154, and connect ON/OFF switch 154 to controller 152, so that toggling ON/OFF switch 154 toggles a supply of power from battery compartment 150 to controller 152.

In the example shown, illuminable graphic panel 146 is an electroluminescent panel that includes a bus 174 for receiving control signals. Controller 152 is electrically connected to bus 174 for sending electrical control signals to graphic panel 146. Graphic panel 146 may be configured to selectively illuminate in response to these control signals. In some embodiments, when ON/OFF switch 154 is toggled to provide power to controller 152, controller 152 executes a program routine stored in its internal memory which causes controller 152 to send a predetermined pattern of control signals to graphic panel 146 such that different portions of graphic panel illuminate from time to time, preferably according to a preset pattern.

If electronics unit 148 is positioned at the bottom of volume 148 and inner sleeve 114 is closed by a lower panel 138, then lower end 140 of longitudinally extending wall 124 of inner sleeve 114 is spaced from a bottom end 144 of outer sleeve 116 so as to provide a space for electronics unit 148 or other elements to be housed inside outer sleeve 116 proximate bottom end 144. For example, inner sleeve 114 may include an abutment member, such as flange 132, to limit the extent of insertion of inner sleeve 114 into outer sleeve 116. In this example, flange 132 may abut with upper end of 118 to prevent further insertion of inner sleeve 114 into outer sleeve 116. Alternatively or in addition, inner sleeve 114 may include one or more legs 176 which extend from longitudinally extending wall 124 and/or lower panel 138. Leg(s) 176 may abut a closed bottom of outer sleeve 116 (e.g. bottom panel 142) to prevent further insertion of inner sleeve 114 into outer sleeve 116. Optionally, leg(s) 176 may be secured to bottom panel 142 by any suitable means, such as by fasteners 178, adhesives, or welds for example.

In some embodiments, controller 152 is connected to inner sleeve 114. Advantageously, this may provide a more convenient assembly in which bus 174 of illuminable graphic panel 146 may be connected to controller 152, and then a subassembly of inner sleeve 114, controller 152, and graphic panel 146 may be inserted as one into outer sleeve 116. For example, outer container assembly 102 may include a controller mount 180 that is fastened to both controller 152 and lower panel 138 of inner sleeve 114, e.g. by screws 182, adhesives, or welds. In the example shown, lower panel 138 includes a mount housing 184 that extends downwardly to receive a portion of controller mount 180. Alternatively, controller 152 may be directly fastened to lower panel 138 of inner sleeve 114. An advantage of this design is that the replacement of illuminable graphic panel 146 may be simplified.

Figure 7C:
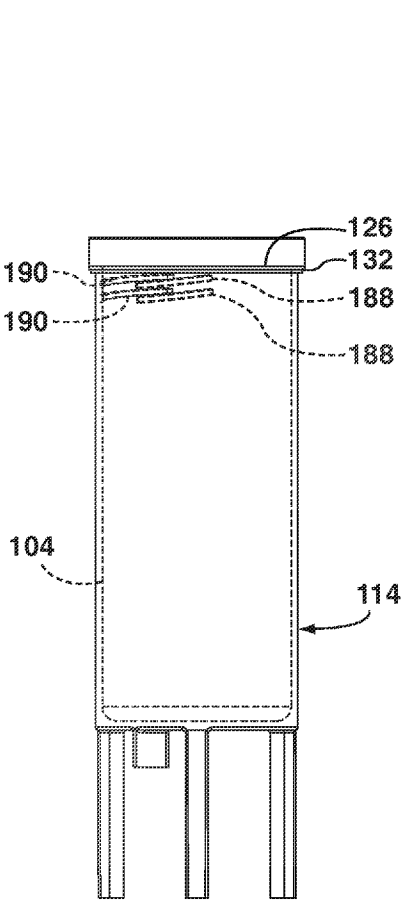
FIGS. 7A-7C show plan views illustrating the securement of an inner container inside an inner sleeve, in accordance with at least one embodiment.
Figure 7B:
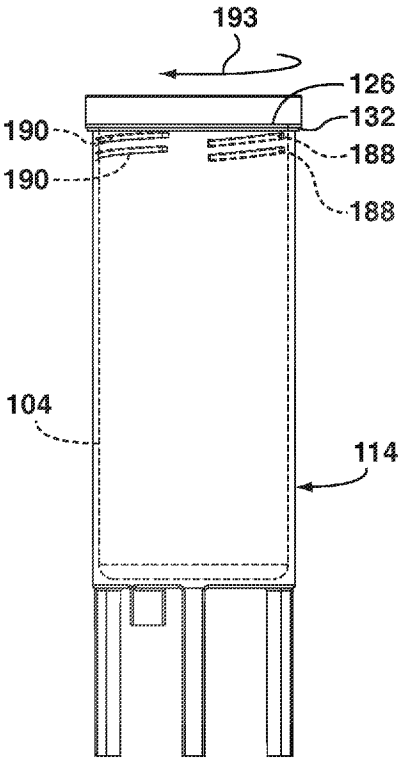
Figure 7A:
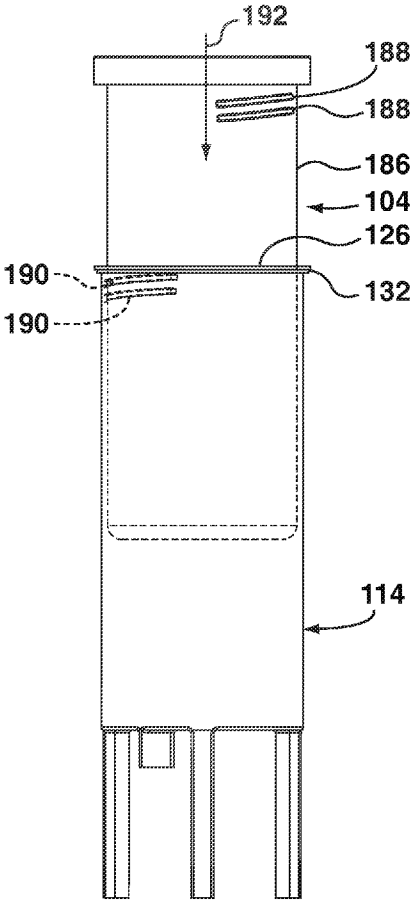

In some embodiments, inner container 104 may be releasably lockable to outer container assembly 102. For example, inner container 104 may be slidably receivable into inner sleeve 114 and rotatably securable thereto. FIGS. 7A to 70 show plan views illustrating the securement of inner container 104 inside inner sleeve 114, in accordance with at least one embodiment. In the example shown, an outer surface 186 of inner container 104 includes a plurality of locking members 188, and an inner surface of inner sleeve 114 includes a plurality of mating locking members 190. As shown, inner container 104 may be inserted into inner sleeve 114 in the direction of arrow 192, and then rotated in the direction of arrow 193 to mate locking members 188 and 190 thereby releasably locking inner container 104 to inner sleeve 114. In alternative embodiments, inner container 104 and inner sleeve 114 include other suitable locking mechanism, such as a bayonet lock, a helical thread lock (as in a bottle cap), or a spring latch for example.

Preferably, inner container 104 extends above opening 126 of inner sleeve 114 and upper end 134 of outer sleeve 116, which may provide a surface to grasp inner container 104 when manipulating inner container 104 during insertion, removal, locking and unlocking. For example, inner container 104 may include a flange 195 that extends above opening 126 of inner sleeve 114, and upper end 134 of outer sleeve 116 when inner container 104 is inserted into outer container assembly 102.

Figure 8:
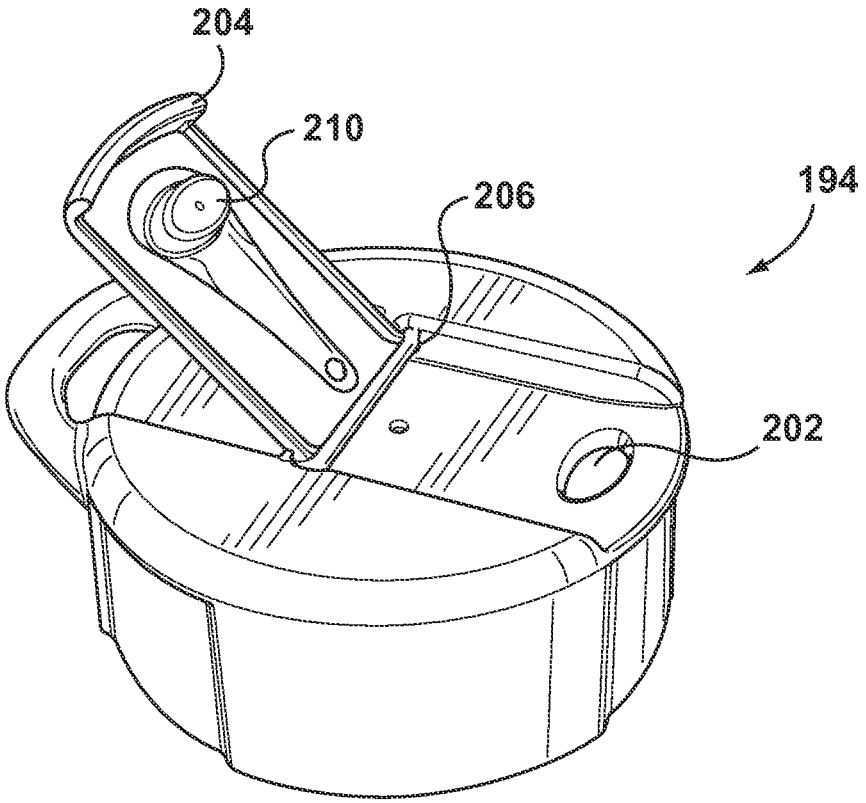
FIG. 8 shows a top perspective view of a lid, in accordance with at least one embodiment; and, FIG. 9 shows a top perspective view of a thermal container kit, in accordance with at least one embodiment.

Thermal container 100 may also include a lid 194 to close opening 112 of inner container 104 and preferably seal internal volume 110 and its contents. Any lid known in the thermal container arts may be used and it may re removable from thermal container 100 by any means known in the thermal container arts. FIG. 8 exemplifies a lid 194 that is releasably securable to one or both of inner container 104 and outer container assembly 102. For example, lid 194 may include internal helical threads 196 (see FIG. 3) that releasably engage mating external threads 198 provided on an upper end of outer sleeve 116. Directly securing lid 194 to outer sleeve 116 instead of to inner container 104 may advantageously prevent the rotational lock of lid 194 from interfering with the rotational lock of inner container 104 to inner sleeve 114. For example, rotatably securing or unsecuring lid 194 to inner container 104 may rotate inner container 104 relative to inner sleeve 114. This may undesirably unsecure inner container 104 from inner sleeve 114. Still, in alternative embodiments, lid 194 is rotatably secured to inner container 104, and inner container 104 is rotatably secured to inner sleeve 114. Optionally, lid 194 includes a gasket, such as O-ring 200 which may enhance a seal between lid 194 and inner container 104.

Optionally, lid 194 defines a drinking opening 202. Preferably, lid 194 is operable to selectively close drinking opening 202. For example, lid 194 may include a flap or other closure member 204 that is moveable between a closed position in which the drinking opening 202 is closed, and an open position in which the drinking opening 202 is open. In the example shown, flap 204 is pivotal, between the open and closed positions, about an axle 206 the ends of which are received in axle mounts 208 (see FIG. 2). Optionally, flap 204 may also include a plug 210 sized to form a liquid-tight seal with drinking opening 202 when flap 204 is in the closed position.

Figure 9:
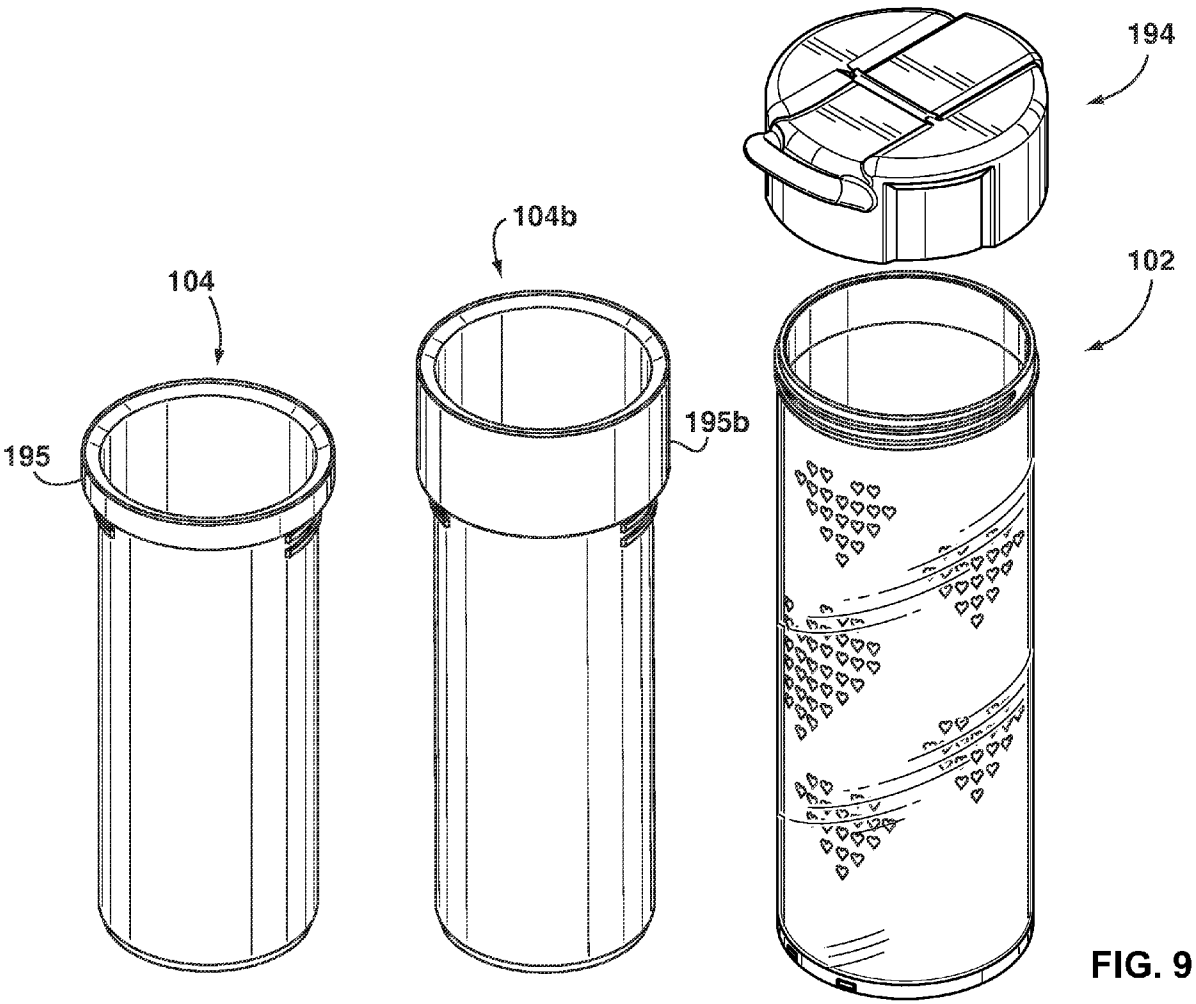

In some embodiments, thermal container 100 may be provided in a kit which may include one or more alternative components. For example, a thermal container kit may include a plurality of inner containers 104, inner sleeves 114, outer sleeves 116, illuminable graphic panels 146 (e.g. having different graphics), and/or lids 194. FIG. 9 shows an example of a thermal container kit 300 comprising an outer container 102 and a plurality of inner containers 104 at least some of which have a different height. As shown, thermal container kit 300 comprises outer container assembly 102, a lid 194, a first inner container 104, and a second inner container 104*b*. In this example, first and second inner containers 104 and 104*b* may be alternatively inserted into outer container assembly 102. Optionally, second inner container 104*b* may include a taller flange 195*b* which may extend further above an upper end of outer sleeve 116 as compared with flange 195 of first inner container 104. Advantageously, this may provide additional support and stability for holding, e.g. flowers or kitchen utensils in an upright orientation.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A thermal container comprising:

a) an outer container assembly comprising a longitudinally extending outer sleeve having a top end, a bottom end and engagement members provided on an outer surface of the top end and a longitudinally extending inner sleeve having a longitudinally extending wall, a top end and a closed bottom end, the inner sleeve is spaced from and faces the outer sleeve to define a volume between the inner and outer sleeves, a bottom panel closing the bottom end of the outer sleeve;

b) a first inner container removably receivable in the inner sleeve and having a longitudinally extending wall and a closed bottom positioned above the closed bottom end of the inner sleeve when the inner container is positioned in the outer container assembly wherein the longitudinally extending wall of the first inner container is rotatably securable to an inner surface of the longitudinally extending wall of the inner sleeve; and, d) a lid having engagement members that releasably engage the engagement members on the outer surface of the top end of the outer sleeve whereby the lid is removably securable to the top end of the outer sleeve.

2. The thermal container of claim 1 wherein the inner sleeve is slidably receivable in the top end of the outer sleeve, the inner sleeve has an abutment member limiting the extent of insertion of the inner sleeve into the outer sleeve and the bottom panel is secured to the inner sleeve.

3. The thermal container of claim 2 wherein the abutment member comprises a flange at the top end of the inner sleeve.

4. The thermal container of claim 3 wherein the inner sleeve comprises a sidewall and a plurality of legs, the sidewall having a lower end spaced from the bottom end of the outer sleeve and the plurality of legs extend downwardly from the sidewall.

5. The thermal container of claim 1 wherein the inner sleeve comprises a sidewall and a plurality of legs, the sidewall having a lower end spaced from the bottom end of the outer sleeve and the plurality of legs extend downwardly from the sidewall.

6. The thermal container of claim 5 wherein the bottom panel is securable to the plurality of legs.

7. The thermal container of claim 1 wherein the inner sleeve comprises a sidewall and a plurality of legs, the sidewall having a lower end spaced from the bottom end of the outer sleeve and the plurality of legs extend downwardly from the sidewall and a lower panel closing the lower end of the sidewall.

8. The thermal container of claim 1, wherein a controller is mounted to the inner sleeve.

9. The thermal container of claim 8 wherein the inner sleeve comprises a sidewall and a plurality of legs, the sidewall having a lower end spaced from the bottom end of the outer sleeve and the plurality of legs extend downwardly from the sidewall, a lower panel closing the lower end of the sidewall and a controller mount is provided on the lower panel on the inner sleeve.

10. The thermal container of claim 1 wherein the lid has a drinking opening and a flap moveable between a closed position in which the drinking opening is closed and an open position.

11. The thermal container of claim 1 further comprising a second inner container, the second inner container having a longitudinally extending sidewall that has a top end that is positioned above the top end of the outer sleeve when the second inner container is positioned in the outer container assembly.

12. A thermal container comprising:

a) an outer container assembly comprising a longitudinally extending outer sleeve having a top end and a bottom end and a longitudinally extending inner sleeve having an longitudinally extending wall, a top end and a closed bottom end, the inner sleeve is spaced from and faces the outer sleeve to define a volume between the inner and outer sleeves;

b) an inner container having a longitudinally extending wall and a closed bottom, the inner container is removably receivable in the inner sleeve and has engagement members that are releasably lockably securable to mating engagement members provided on the inner sleeve; and, c) a lid having engagement members that releasably engage engagement members on the top end of the outer sleeve whereby the lid is removably securable to the top end of the outer sleeve wherein, when the lid is disengaged from the outer sleeve, the inner container is removable from the outer container assembly and when the inner container is inserted into the outer container assembly, the inner container is securable in position in the inner sleeve.

13. The thermal container of claim 12 wherein the inner sleeve is slidably receivable in the top end of the outer sleeve, the inner sleeve has an abutment member limiting the extent of insertion of the inner sleeve into the outer sleeve.

14. A thermal container kit comprising:

a) an outer container assembly comprising a longitudinally extending outer sleeve having a top end and a bottom end and a longitudinally extending inner sleeve having an longitudinally extending wall, a top end and a closed bottom end, the inner sleeve is spaced from and faces the outer sleeve to define a volume between the inner and outer sleeves;

b) a first inner container having a longitudinally extending wall and a closed bottom, the first inner container is removably receivable in the inner sleeve wherein the longitudinally extending wall of the first inner container is rotatably securable to the longitudinally extending wall of the inner sleeve;

c) a second inner container that is alternately removably receivable in the inner sleeve, the second inner container having a longitudinally extending sidewall that has a top end that is positioned above the top end of the outer sleeve when the second inner container is positioned in the outer container assembly wherein the longitudinally extending wall of the second inner container is also rotatably securable to the longitudinally extending wall of the inner sleeve; and, d) a lid having engagement members that releasably engage engagement members on the top end of the outer sleeve whereby the lid is removably securable to the top end of the outer sleeve.

* * * * *